US010820090B2

(12) United States Patent
Yu et al.

(10) Patent No.: US 10,820,090 B2
(45) Date of Patent: Oct. 27, 2020

(54) SPEAKER ASSEMBLY

(71) Applicant: AAC Technologies Pte. Ltd., Singapore (SG)

(72) Inventors: Pengfei Yu, Shenzhen (CN); Tao Shao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/427,133

(22) Filed: May 30, 2019

(65) Prior Publication Data

US 2019/0373360 A1 Dec. 5, 2019

(30) Foreign Application Priority Data

Jun. 1, 2018 (CN) ..... 2018 2 0852312 U

(51) Int. Cl.
*H04R 1/22* (2006.01)
*H04R 1/02* (2006.01)
*H04R 1/28* (2006.01)

(52) U.S. Cl.
CPC ..... *H04R 1/227* (2013.01); *H04R 1/02* (2013.01); *H04R 1/025* (2013.01); *H04R 1/2811* (2013.01); *H04R 1/2819* (2013.01); *H04R 1/2873* (2013.01)

(58) Field of Classification Search
CPC . H04R 1/02; H04R 1/025; H04R 1/22; H04R 1/227; H04R 1/28; H04R 1/2803; H04R 1/2811; H04R 1/2815; H04R 1/2819; H04R 1/2873; H04R 9/063; H04R 2499/11; H04M 1/035
USPC ..... 381/337, 345–352, 186
See application file for complete search history.

(56) References Cited

U.S. PATENT DOCUMENTS

2003/0003945 A1* 1/2003 Saiki ..... H04M 1/03 455/550.1
2009/0136065 A1* 5/2009 Yano ..... H04R 1/24 381/186
2014/0029779 A1* 1/2014 Yamauchi ..... H04N 5/642 381/333
2014/0177902 A1* 6/2014 Yeh ..... H04R 1/227 381/394
2015/0358705 A1* 12/2015 Chen ..... H04R 1/2842 381/386

* cited by examiner

*Primary Examiner* — Jesse A Elbin
(74) *Attorney, Agent, or Firm* — IPro, PLLC; Na Xu

(57) ABSTRACT

The present disclosure discloses a speaker assembly, including: a housing with an accommodation space formed by a top wall, a bottom wall, and a sidewall; a speaker received in the accommodation space. The speaker includes a first unit having a first diaphragm and a second unit having a second diaphragm; a first back cavity formed by the first unit and the bottom wall; a second back cavity formed by the second unit and the top wall. An auxiliary cavity is formed by the second diaphragm and the bottom wall; a partition wall connecting between the top wall and the bottom wall for separating the auxiliary cavity from the first back cavity. The partition wall has a through hole corresponding to the second diaphragm. The second unit has a side adjacent to the second diaphragm fixed to the partition wall.

7 Claims, 2 Drawing Sheets

SPEAKER ASSEMBLY

FIELD OF THE PRESENT DISCLOSURE

The present disclosure relates to the field of electromagnetic transducers, more particularly to a speaker assembly used in a portable electronic device.

DESCRIPTION OF RELATED ART

A speaker is a very important component equipped in a mobile phone for producing audible sounds. A speaker generally uses a diaphragm to produce vibration and further to generate sounds.

A speaker assembly is a component containing a speaker and a housing receiving the speaker. Compared to a speaker, a speaker box has a relatively larger back volume and better low frequency acoustic performance. The speaker box has a sound aperture for radiating sound. The speaker assembly is generally a long-and-narrow configuration and placed deviating from a center of the housing for balancing the acoustic performance and the occupation. However, such a configuration causes uneven air flow and further causes vacillation of the speaker.

Therefore, an improved speaker assembly is desired.

SUMMARY OF THE PRESENT DISCLOSURE

One of the primary objects of the present disclosure is to provide a speaker assembly capable of reducing vacillation and improving low frequency acoustic performance.

Therefore, the present disclosure provides a speaker assembly, including: a housing with an accommodation space formed by a top wall, a bottom wall opposite to the top wall, and a sidewall connecting the top wall to the bottom wall; a speaker received in the accommodation space, including a first unit having a first diaphragm and a second unit having a second diaphragm; a first back cavity formed by the first unit and the bottom wall; a second back cavity formed by the second unit and the top wall; a back volume formed cooperatively by the first back cavity and the second back cavity; an auxiliary cavity formed by the second diaphragm and the bottom wall; a partition wall connecting between the top wall and the bottom wall for separating the auxiliary cavity from the first back cavity, the partition wall having a through hole corresponding to the second diaphragm; wherein the second unit has a side adjacent to the second diaphragm fixed to the partition wall.

Further, the partition wall includes a first extending wall extending from the top wall toward the bottom wall for separating the second back cavity from the auxiliary cavity, a second extending wall extending from the bottom wall toward the top wall for separating the first back cavity from the auxiliary cavity, and a supporting wall extending between the first extending wall and the second extending wall, the through hole is formed in the supporting wall; the second unit is fixed on the supporting wall.

Further, the top wall includes an opening corresponding to the first diaphragm of the first unit, and the first unit has a side adjacent to the first diaphragm fixed to the top wall.

Further, the top wall includes a first opening corresponding to the first unit and the second unit, a first main body for connecting the first extending wall and the sidewall, and a first cover engaging the first opening for connecting the first main body to the sidewall; the first cover includes a first fastening slot for positioning the first unit.

Further, the bottom wall includes a second opening corresponding to the second unit, a second main body for connecting the second extending wall to the sidewall, a second cover engaging with the second opening for connecting the second main body and the sidewall.

Further, the first main body, the supporting wall, the second main body and the sidewall are integral with each other.

Further, the first unit is identical to the second unit.

Further, wherein the supporting wall is disposed at a central portion of the housing.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
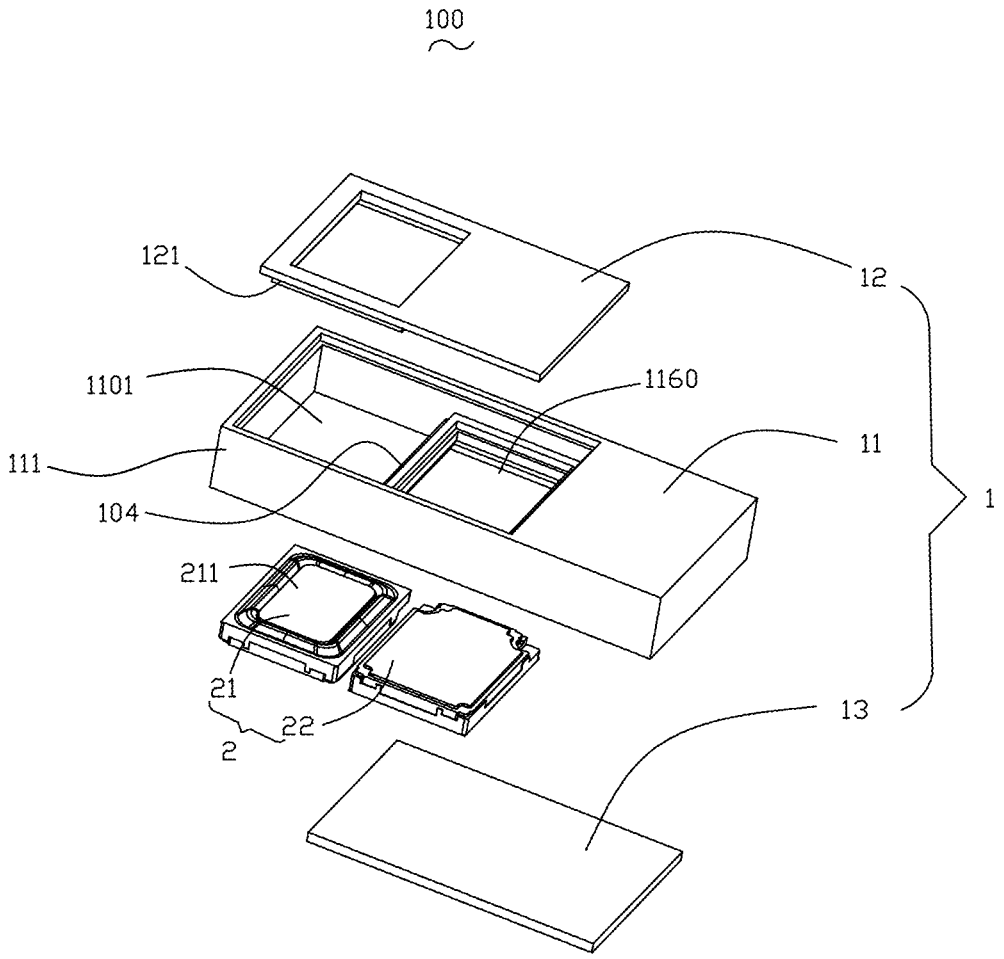
FIG. 1 is an isometric and exploded view of a speaker assembly in accordance with an exemplary embodiment of the present disclosure.
Figure 2:
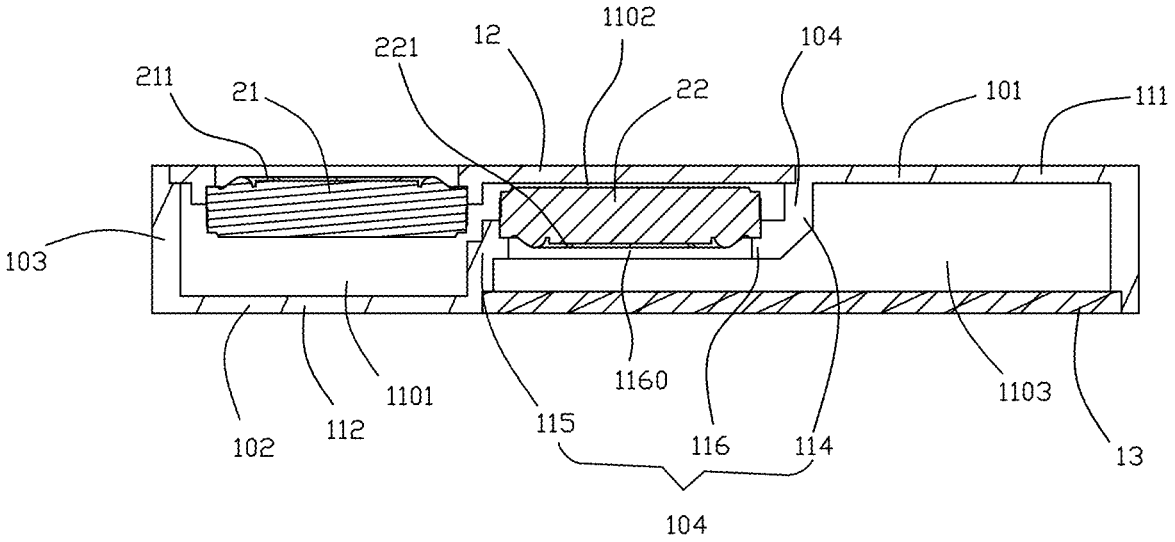
FIG. 2 is cross-sectional view of the speaker assembly in FIG. 1.

Referring to FIGS. 1-2, the present disclosure provides a speaker assembly 100 including a housing 1 with an accommodation space and a speaker 2 received in the accommodation space.

The speaker 2 includes a first unit 21 and a second unit 22. In the embodiment, the first unit 21 is an electro-magnetic transducer with a first diaphragm 211, and the second unit 22 is an electro-magnetic transducer with a second diaphragm 221. Optionally, the first and units 21, 22 are two transducers with the same structure and the same dimensions. Each of the first and second units includes a voice coil for driving the corresponding diaphragm to vibrate for pushing the air to produce sound waves. The first unit 21 is arranged opposite to the second unit 22, which means the first diaphragm 211 of the first unit 21 is arranged upwards, and the second diaphragm 221 of the second unit 22 is arranged downwards.

The housing 1 includes a top wall 101, a bottom wall 102, and a sidewall 103 for connecting the top wall 101 to the bottom wall 102, further for forming the accommodation space. The housing 1 further includes a partition wall 104 for dividing the accommodation space.

The speaker 2 is received in the accommodation space. The first diaphragm 211 of the first unit 21 faces the top wall 101. The second diaphragm 221 of the second unit 22 faces the bottom wall 102 and keeps a distance from the bottom wall 102.

The first unit 21 and the bottom wall 102 cooperatively form a first back cavity 1101, the second unit 22 and the top wall 101 cooperatively form a second back cavity 1102, and the second diaphragm 221 forms an auxiliary cavity 1103 cooperatively with the sidewall 102. The partition wall 104 is disposed between the first cavity 1101 and the auxiliary cavity 1103.

The partition wall 104 includes a first extending wall 114 extending from the top wall 101 toward the bottom wall 102, a second extending wall 115 extending from the bottom wall 102 toward the top wall 101, and a supporting wall 116 extending between the first extending wall 114 and the second extending wall 115. The supporting wall 116 faces the second diaphragm 221. The supporting wall 116 is provided with a through hole 1160 penetrating therethrough. The second unit 22 is fixed with a side of the second unit adjacent to the second diaphragm 221 positioned in the through hole 1160. The first extending wall 114 separates the second back cavity 1102 from the auxiliary cavity 1103.

In the embodiment, the housing 1 includes a middle frame 11, a first cover 12, and a second cover 13. The middle frame 11 includes two openings at two ends thereof. The top wall 101 includes a first opening corresponding to the first unit 21 and the second unit 22, and the first cover 12 engages with the first opening. The bottom wall 102 includes a second opening corresponding to the second unit 22, and the second cover 13 covers the second opening. The middle frame 11 further includes a first main body 111 for connecting the firs extending wall 114 and the sidewall 103, and a second main body 112 for connecting the second extending wall 115 and the sidewall 103. The first main body 111 and the first cover 12 cooperatively form the top wall 101 housing the housing; the second main body 112 and the second cover 13 cooperatively form the bottom wall 102 of the housing. Optionally, the middle frame 11 is an integral structure.

The first cover 12 includes a first fastening slot 121 for positioning the first unit 21. The first unit 21 is fixed on the first cover 12 by the first fastening slot 121, and then the first cover 12 with the first unit 21 is fixed to the middle frame 11.

When the first unit 21 vibrates, the second unit 22 pushes the air for remedying the air flow produced by the first unit 21, which effectively reduces the vacillation of the speaker assembly, and further reduces low frequency distortion for improving low frequency acoustic performance.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker assembly, including:

a housing with an accommodation space formed by a top wall, a bottom wall opposite to the top wall, and a sidewall connecting the top wall to the bottom wall;

a speaker received in the accommodation space, including a first unit having a first diaphragm and a second unit having a second diaphragm;

a first back cavity formed by the first unit and the bottom wall;

a second back cavity formed by the second unit and the top wall;

a back volume formed cooperatively by the first back cavity and the second back cavity;

an auxiliary cavity formed by the second diaphragm and the bottom wall;

a partition wall connecting between the top wall and the bottom wall for separating the auxiliary cavity from the first back cavity, the partition wall having a through hole corresponding to the second diaphragm; wherein the second unit has a side adjacent to the second diaphragm fixed to the partition wall; and the first unit is identical to the second unit.

2. The speaker assembly as described in claim 1, wherein the partition wall includes a first extending wall extending from the top wall toward the bottom wall for separating the second back cavity from the auxiliary cavity, a second extending wall extending from the bottom wall toward the top wall for separating the first back cavity from the auxiliary cavity, and a supporting wall extending between the first extending wall and the second extending wall, the through hole is formed in the supporting wall; the second unit is fixed on the supporting wall.

3. The speaker assembly as described in claim 2, wherein the top wall includes an opening corresponding to the first diaphragm of the first unit, and the first unit has a side adjacent to the first diaphragm fixed to the top wall.

4. The speaker assembly as described in claim 3, wherein the top wall includes a first opening corresponding to the first unit and the second unit, a first main body for connecting the first extending wall and the sidewall, and a first cover engaging the first opening for connecting the first main body to the sidewall; the first cover includes a first fastening slot for positioning the first unit.

5. The speaker assembly as described in claim 4, wherein the bottom wall includes a second opening corresponding to the second unit, a second main body for connecting the second extending wall to the sidewall, a second cover engaging with the second opening for connecting the second main body and the sidewall.

6. The speaker assembly as described in claim 5, wherein the first main body, the supporting wall, the second main body and the sidewall are integral with each other.

7. The speaker assembly as described in claim 2, wherein the supporting wall is disposed at a central portion of the housing.

* * * * *